US006588754B1

(12) United States Patent
Adams et al.

(10) Patent No.: US 6,588,754 B1
(45) Date of Patent: Jul. 8, 2003

(54) METHOD FOR PLAYING CASINO BOARD GAME

(76) Inventors: Gabe Adams, 1678 Beryl La., Corona, CA (US) 91720; Edmund Adams, 1678 Beryl La., Corona, CA (US) 91720

( * ) Notice: Subject to any disclaimer, the term of this patent is extended or adjusted under 35 U.S.C. 154(b) by 1 day.

(21) Appl. No.: 09/612,398

(22) Filed: Jul. 5, 2000

(51) Int. Cl.[7] ..... A63F 3/08
(52) U.S. Cl. ..... 273/274
(58) Field of Search ..... 273/256, 274, 273/201

(56) References Cited

U.S. PATENT DOCUMENTS 4,915,391 A * 4/1990 Aharonian ..... 273/256
4,930,789 A * 6/1990 Harris et al. ..... 273/256
4,932,668 A * 6/1990 Steward ..... 273/256
5,810,359 A * 9/1998 Wilkins et al. ..... 273/256

* cited by examiner

*Primary Examiner*—Paul T. Sewell
*Assistant Examiner*—M. Chambers

(57) ABSTRACT

A casino board game method comprised of providing a board, a plurality of playing chips, dice, playing pieces, HOTEL CARDS, CASINOS CARDS, and playing money. A roulette wheel is located within the center of the board with rectangular spaces extending around the periphery of the board for movement of the playing pieces of the players.

1 Claim, 3 Drawing Sheets

METHOD FOR PLAYING CASINO BOARD GAME

BACKGROUND OF THE INVENTION

1. Field of the Invention

The present invention relates to a casino board game apparatus and more particularly pertains to simulating a visit to casinos of Las Vegas with a casino board game apparatus.

2. Description of the Prior Art

The use of casino board games is known in the prior art. More specifically, casino board games heretofore devised and utilized for the purpose of accumulating money and real estate are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,228,698 to Dubarry, Jr. discloses a casino board game apparatus.

U.S. Pat. No. 5,169,154 to Borghi discloses a casino board game.

U.S. Pat. No. 4,930,789 to Harris et al. discloses a casino board game.

U.S. Pat. No. 5,129,652 to Wilkinson discloses a casino drawing/lottery game and case/prize management system.

U.S. Pat. No. 4,357,015 to Santora et al. discloses a roulette game.

U.S. Pat. No. Des. 298,557 to McNally discloses the ornamental design for an amusement roulette game table.

While these devices fulfill their respective, particular objective and requirements, the aforementioned patents do not describe a casino board game apparatus for simulating a visit to casinos of Las Vegas.

In this respect, the casino board game apparatus according to the present invention substantially departs from the conventional concepts and designs of the prior art, and in doing so provides an apparatus primarily developed for the purpose of simulating a visit to casinos of Las Vegas.

Therefore, it can be appreciated that there exists a continuing need for new and improved casino board game apparatus which can be used for simulating a visit to casinos of Las Vegas. In this regard, the present invention substantially fulfills this need.

SUMMARY OF THE INVENTION

In the view of the foregoing disadvantages inherent in the known types of casino board games now present in the prior art, the present invention provides an improved casino board game apparatus. As such, the general purpose of the present invention, which will be described subsequently in greater detail, is to provide a new and improved casino board game apparatus and method which has all the advantages of the prior art and none of the disadvantages.

To attain this, the present invention essentially comprises a playing board having an outer board area. The outer board area has a plurality of individual spaces around an outer periphery of the playing board. Each of the individual spaces defines a hotel or casino. One of the individual spaces is designated as TRY YOUR LUCK. One of the individual spaces is designated as GO TO JAIL. One of the individual spaces is designated as IN JAIL. One of the individual spaces is designated as START. The plurality of individual spaces define a path of travel for players. The playing board has an inner board area. The inner board area has a roulette table disposed thereon. The inner board area has designated areas for TRY YOUR LUCK cards. The game includes a plurality of playing chips for roulette around the playing board. The game includes a pair of playing dice to determine the amount of movement of the plurality of playing pieces around the outer board area. The game includes a plurality of HOTEL CARDS. Each of the HOTEL CARDS has the name of a particular hotel thereon corresponding to an individual playing space with that particular hotel designated thereon. The game includes a plurality of CASINOS CARDS. Each of the CASINO CARDS has the name of a particular casino thereon corresponding to an individual playing space with that particular casino designated thereon. The game includes a plurality of playing money.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved casino board game apparatus which has all the advantages of the prior art casino board games and none of the disadvantages.

It is another object of the present invention to provide a new and improved casino board game apparatus which may be easily and efficiently manufactured and marketed.

It is a further object of the present invention to provide a new and improved casino board game apparatus which is of durable and reliable construction.

An even further object of the present invention is to provide a new and improved casino board game apparatus which is susceptible of a low cost of manufacture with regard to both materials and labor, and which accordingly is then susceptible of low prices of sale to the consuming public, thereby making such a casino board game apparatus economically available to the buying public.

Still yet another object of the present invention is to provide a new and improved casino board game apparatus which provides in the apparatuses and methods of the prior art some of the advantages thereof, while simultaneously overcoming some of the disadvantages normally associated therewith.

Even still another object of the present invention is to provide a new and improved casino board game apparatus for simulating a visit to casinos of Las Vegas.

Lastly, it is an object of the present invention to provide a new and improved casino board game apparatus comprised of a playing board. A plurality of playing chips are included for roulette-like movement around the playing board. The game includes a plurality of HOTEL CARDS. The game includes a plurality of CASINO CARDS. The game includes a plurality of playing money.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
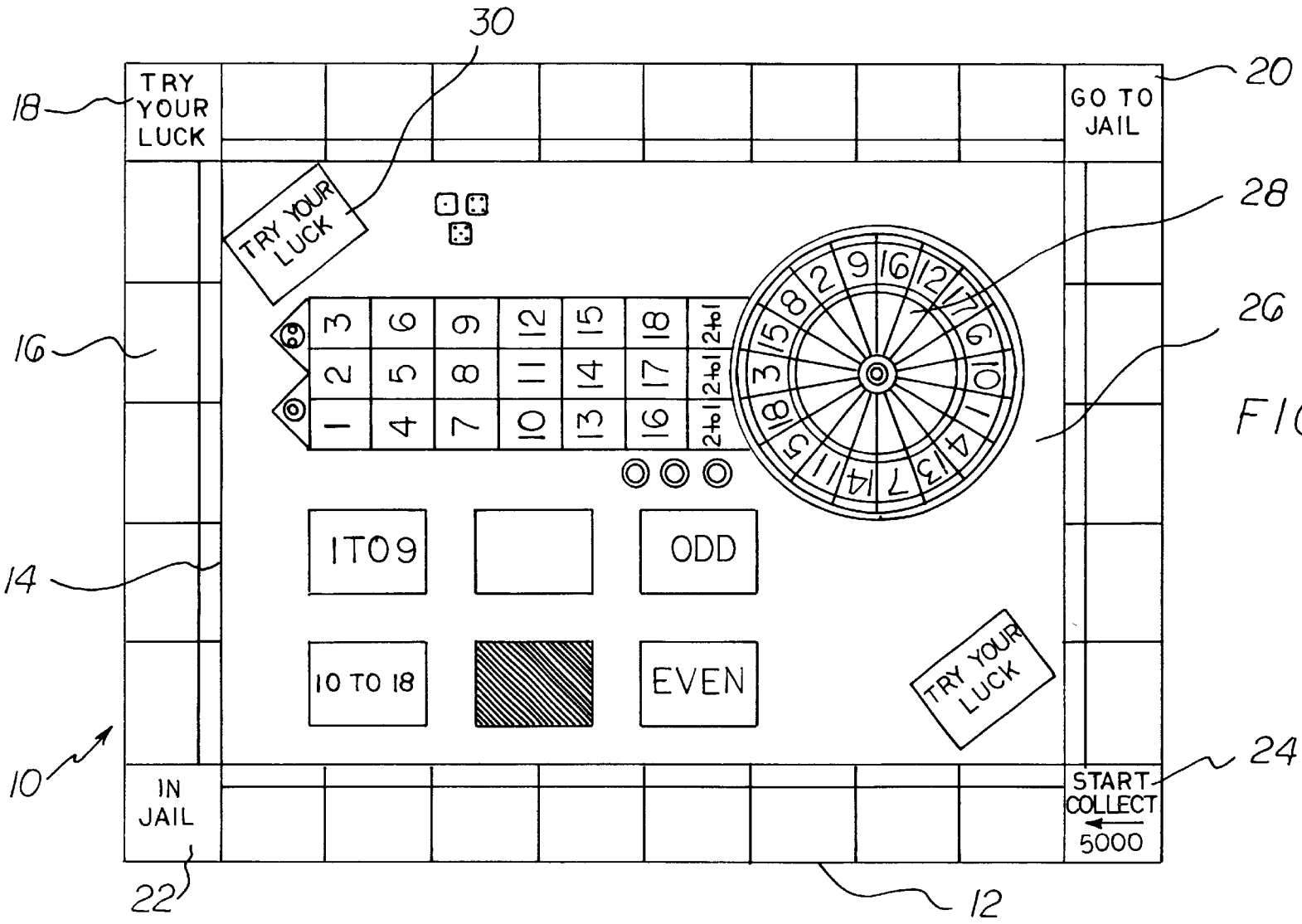
FIG. 1 is a plan view of the preferred embodiment of the casino board game apparatus constructed in accordance with the principles of the present invention.
Figure 2:
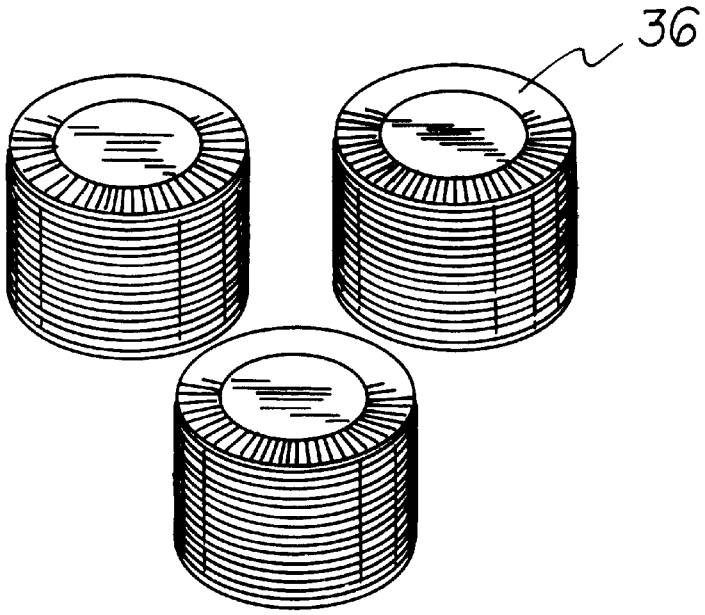
FIG. 2 is a perspective view of the playing chips of the present invention.
Figure 3:
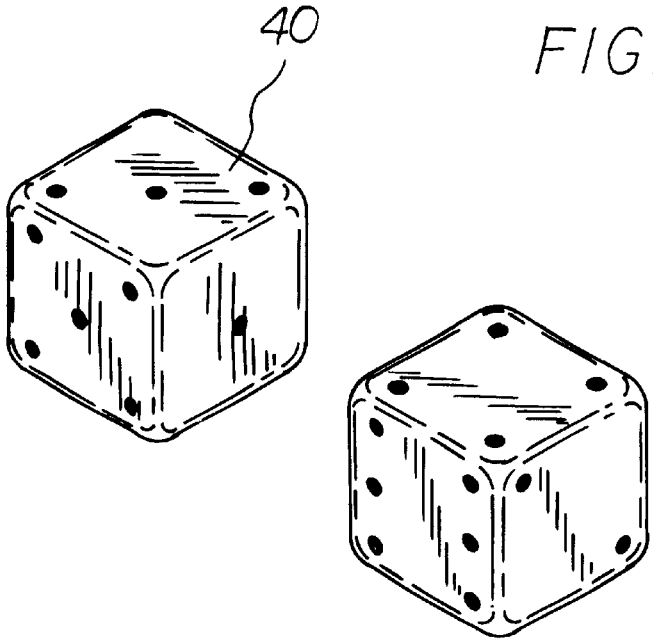
FIG. 3 is a perspective view of the dice of the present invention.
Figure 4:
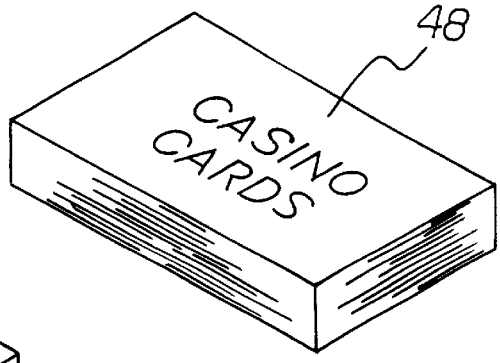
FIG. 4 is a perspective view of the casino cards of the present invention.
Figure 5:
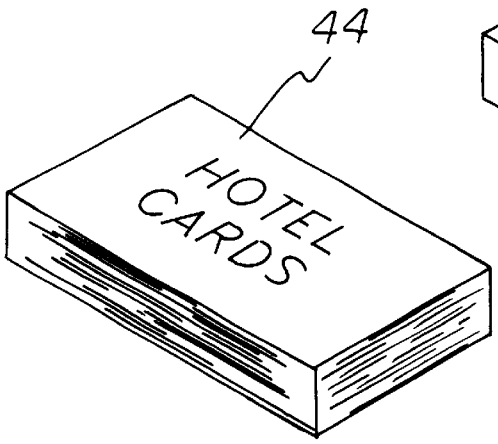
FIG. 5 is a perspective view of the hotel cards of the present invention.
Figure 6:
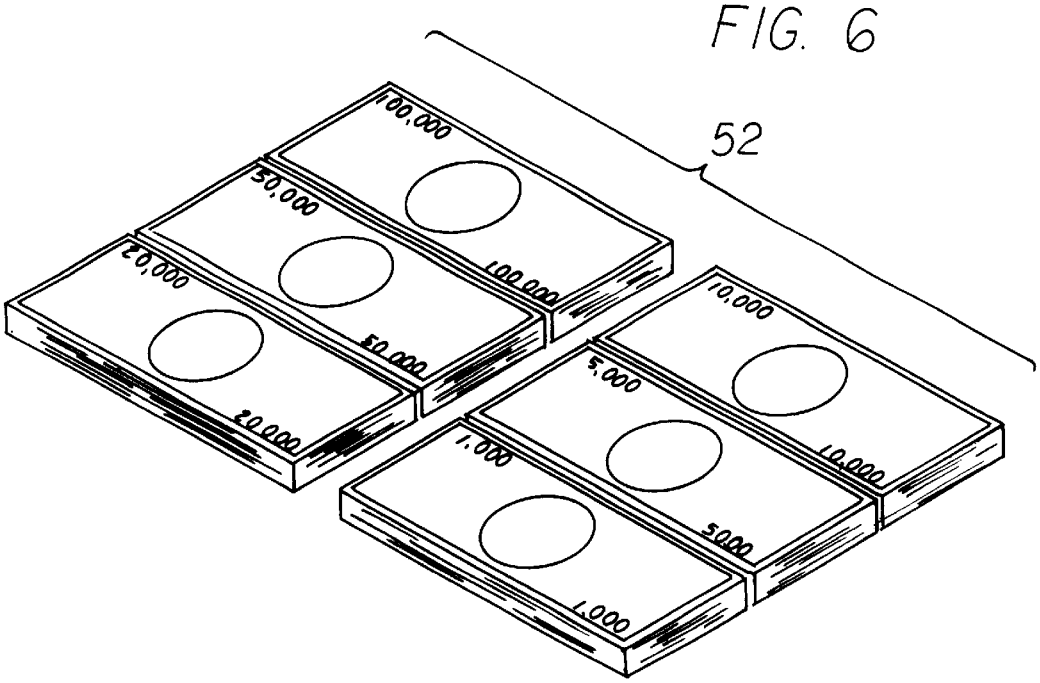
FIG. 6 is a perspective view of the money of the present invention.

With reference now to the drawings and, in particular, to FIG. 1 thereof, the preferred embodiment of the new and improved casino board game apparatus embodying the principles and concepts of the present invention and generally designated by the reference number 10 will be described.

Specifically, it will be noted in the various Figures that the device relates to a new and improved casino board game apparatus for simulating a visit to casinos of Las Vegas. In its broadest context, the device consists of a playing board, a plurality of playing chips, a pair of dice, a plurality of HOTEL CARDS, a plurality of CASINO CARDS, and playing money. Such components are individually configured and correlated with respect to each other so as to attain the desired objective.

The game includes a playing board 12 having an outer board area 14. The outer board 14 area has a plurality of individual spaces 16 around an outer periphery of the playing board 12. Each of the individual spaces 16 defines a hotel or casino. A player must own all three hotels that are adjacent in order to add a casino. Each hotel or casino has a purchase price and a rent space. The player who lands on the hotel or casino has the option to buy the hotel or casino. Once a player owns the hotel or casino he is entitled to certain benefits. First, if the space 16 is a hotel, a different player landing on this space 16 is required to pay rent to the player owning the hotel. If the space is a casino, the player owning the casino can permit a player landing on this space 16 to play roulette, dice, or blackjack in their casino. One of the individual spaces 16 is designated as TRY YOUR LUCK 18. One of the individual spaces 16 is designated as GO TO JAIL 20. One of the individual spaces 16 is designated as IN JAIL 22. One of the individual spaces 16 is designated as START 24. Each time a player passes the START, the player collects 5,000 dollars. The plurality of individual spaces 16 define a path of travel for players. The playing board 12 has an inner board area 26. The inner board area 26 has a roulette table 28 disposed thereon. The inner board 26 area has designated areas for TRY YOUR LUCK cards 30.

The game includes a plurality of playing chips 36 for roulette-like movement around the playing board.

The game includes a pair of playing dice 40 to determine the amount of movement of the plurality of playing pieces 36 around the outer board area 14. The playing dice 40 can also be used for the players to play dice.

The game includes a plurality of HOTEL CARDS 44. Each of the HOTEL CARDS 44 has the name of a particular hotel thereon corresponding to an individual playing space 16 with that particular hotel designated thereon. Once a player draws one of the HOTEL CARDS, the player is directed to that space 16. If the hotel is not owned, the player can buy it. If the hotel is owned by another player, the landing player will pay rent to the owning player.

The game includes a plurality of CASINO CARDS 48. Each of the CASINO CARDS 48 has the name of a particular casino thereon corresponding to an individual playing space 16 with that particular casino designated thereon. Once a player draws one of the CASINO CARDS 48, the player is directed to that space 16. If the casino is not owned, the player can buy it. If the casino is owned by another player, the landing player will be able to play roulette, dice, or blackjack with the permission of the owning player.

The game includes a plurality of playing money 52. Each player is given two million dollars to begin the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A method of playing a casino board game for simulating a visit to casinos of Las Vegas which comprises the steps of:

placing a rectangular playing board having an outer board area with two long sides and two short sides on a receiving surface, the outer board area having a plurality of equally sized individual spaces in a single continues loop with four corner spaces around an outer periphery of the playing board, each of the individual spaces defining a hotel or casino, one of the individual spaces at a corner space designated as TRY YOUR LUCK and one of the individual spaces at a corner space designated as GO TO JAIL with a long side there between, one of the individual spaces at a corner space designated as IN JAIL and one of the individual spaces at a corner designated as START with a long side there between, and with two parallel short sides between the long sides, the plurality of individual spaces defining a single path of travel for players, the playing board having an inner board area, a roulette wheel on the inner board area disposed adjacent to the GO TO JAIL corner with three parallel rows of numbers corresponding to the numbers of the roulette wheel located adjacent to and parallel with the long side between the GO TO JAIL corner and the TRY YOUR LUCK corner, the inner board area having two designated areas for TRY YOUR LUCK cards adjacent to the TRY YOUR LUCK corner and the START corner;

placing a plurality of playing chips onto the playing board;

placing a pair of playing dice onto the playing board, the pair of playing dice determining the amount of movement of the plurality of playing pieces around the outer board area;

placing a plurality of HOTEL CARDS onto the playing board, each of the HOTEL CARDS having the name of a particular hotel thereon corresponding to an individual playing space with that particular hotel designated thereon;

placing a plurality of CASINO CARDS on the playing board, each of the CASINO CARDS having the name of a particular casino thereon corresponding to an individual playing space with that particular casino designated thereon;

giving each player a plurality of playing money;

rolling the dice for movement around the outer board area and allowing a player to land on a space for the purchase of a hotel, players being required to own three hotels that are adjacent in order to purchase a casino, the player landing on a hotel space owned by another player being required to pay rent; and moving around the outer board area and purchasing hotels and casinos along the way.

* * * * *